US006763969B1

(12) United States Patent
Melrose et al.

(10) Patent No.: US 6,763,969 B1
(45) Date of Patent: Jul. 20, 2004

(54) BLOW MOLDED BOTTLE WITH UNFRAMED FLEX PANELS

(75) Inventors: David M. Melrose, Auckland (NZ); Richard K. Ogg, Littlestown, PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 09/980,599

(22) PCT Filed: May 9, 2000

(86) PCT No.: PCT/US00/12625

§ 371 (c)(1),
(2), (4) Date: Oct. 15, 2002

(87) PCT Pub. No.: WO00/68095

PCT Pub. Date: Nov. 16, 2000

Related U.S. Application Data

(60) Provisional application No. 60/133,618, filed on May 11, 1999.

(51) Int. Cl.[7] ..... B65D 6/08

(52) U.S. Cl. ..... 220/669; 220/674; 220/675

(58) Field of Search ..... 220/674, 675, 220/669, 673

(56) References Cited

U.S. PATENT DOCUMENTS

| | | | | |
|---|---|---|---|---|
| D61,658 | S | 11/1922 | Grahm | |
| D98,504 | S | 2/1936 | Ennever | |
| D206,026 | S | 10/1966 | Miller | |
| 3,335,902 | A | 8/1967 | Javorik | 220/72 |
| 3,536,223 | A | 10/1970 | Muhlhoff et al. | |
| 3,536,500 | A | 10/1970 | Cleereman et al. | |
| 3,923,178 | A | 12/1975 | Welker, III | |
| 4,497,855 | A | 2/1985 | Agrawal et al. | 428/35 |
| 4,749,092 | A | 6/1988 | Sugiura et al. | |
| 5,178,289 | A | 1/1993 | Krishnakumar et al. | |
| 5,303,834 | A | 4/1994 | Krishnakumar et al. | |
| 5,381,910 | A | 1/1995 | Sugiura et al. | |
| 5,407,086 | A | 4/1995 | Ota et al. | |
| D362,626 | S | 9/1995 | Rossi | D9/529 |
| D366,416 | S | 1/1996 | Semersky | D9/434 |
| 5,593,056 | A | 1/1997 | Mero et al. | 215/382 |
| 5,690,244 | A | 11/1997 | Darr | 215/382 |
| 5,704,504 | A | 1/1998 | Bueno | 215/381 |
| 5,740,934 | A | 4/1998 | Brady | 215/381 |
| 5,833,115 | A | 11/1998 | Eiten | 220/669 |
| D405,373 | S | 2/1999 | Crawford | D9/543 |
| 6,036,037 | A | 3/2000 | Scheffer et al. | 215/381 |
| D423,939 | S | 5/2000 | Ogg | D9/537 |
| D442,493 | S | 5/2001 | Bretz et al. | D9/538 |

FOREIGN PATENT DOCUMENTS

| | | |
|---|---|---|
| DE | 7202405 U | 4/1972 |
| HU | P9601131 | 5/1997 |
| WO | WO 97/03885 | 2/1997 |
| WO | WO 99/21770 | 5/1999 |

*Primary Examiner*—Joseph Man-Fu Moy
(74) *Attorney, Agent, or Firm*—Howson and Howson

(57) ABSTRACT

A hot-fillable, slender, blow-molded plastic bottle for use in containing hot-filled beverages. The bottle has a sidewall with various interactive zones of function. For example, some of the zones are primarily responsible for accommodating vacuum absorption, while other zones are primarily intended to rigidify the container such as by providing post strength to improve container top loading capability. Although each zone may have a primary function, each zone also aids adjacent zones in providing their functions. Thus, the entire sidewall, and not merely selected locations, reacts to the forces generated by the hot-fill process on the container.

20 Claims, 6 Drawing Sheets

FIG. 3
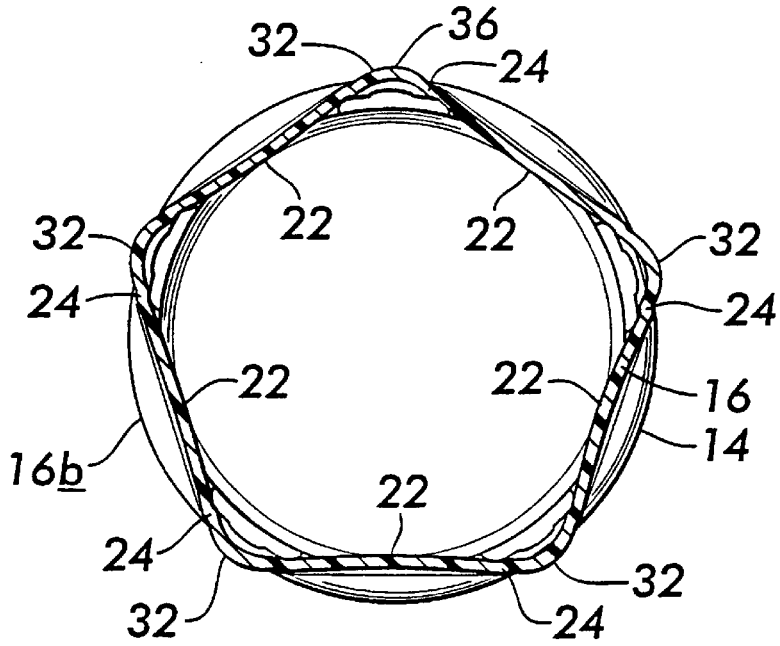
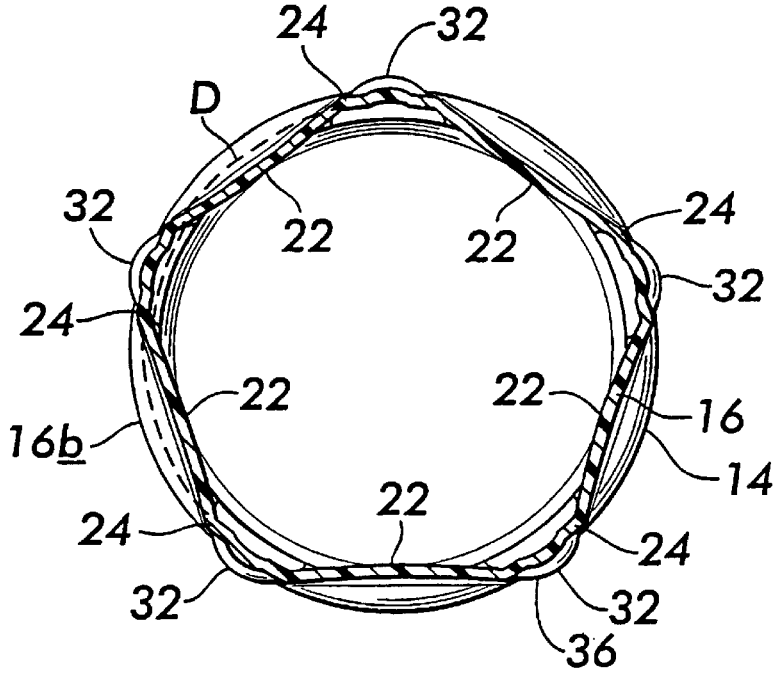
FIG. 4

BLOW MOLDED BOTTLE WITH UNFRAMED FLEX PANELS

This application claims the benefit of provisional application 60/133,618 filed May 11, 1999.

FIELD OF THE INVENTION

The present invention relates to a slender bottle which integrates aesthetic and functional features without clearly segregating such features from one another. More particularly, the present invention relates to a slender blow-molded plastic bottle which is useful in packaging a hot-filled beverage.

BACKGROUND OF THE INVENTION

In the packaging of beverages, especially juice, blow-molded plastic containers made from, for instance, PET, are used in the so-called "hot-fill" process in which containers are filled with a beverage at an elevated temperature. The hot-filled containers are promptly sealed and are permitted to cool resulting in internal pressure and temperature changes that reduce the volume of the sealed container.

It is known to provide hot-fillable containers with a series of well-defined, spaced-apart vacuum flex panels to compensate for the internal volume reduction. The vacuum flex panels provide a sufficient amount of flexure without adversely affecting the structural integrity and aesthetic appearance of the hot-filled container. The adjacent portions of the container, such as the so-called lands, or columns, which are located between, above, and below the flex panels, are intended to resist any deformations which would otherwise be caused by hot-fill processing. Wall thickness variations, or geometric structures, such as ribs, projections and the like, can be utilized to prevent unwanted distortion. Generally, the typical hot-fillable container structure is provided with certain pre-defined areas which flex to accommodate volumetric changes and certain other pre-defined areas which remain unchanged.

An example of a hot-fillable container having a plurality of flex-panels is illustrated in U.S. Design Pat. No. D.366,416 which is owned by the assignee of the present application. The hot-fill bottle has well-defined flex panels which are distinctly visually apparent prior to filling and which accommodate vacuum induced distortions after filling, capping and cooling. The container also has other geometric structures which are completely segregated from the flex panels, which are distinctly visually apparent prior to filling, and which resist structural change caused by volume reduction. Typically, all of these structures are framed about their entire peripheries and are completely separated from the bottle's aesthetic features which are usually limited to the dome of the container. For example, flex panels are often indented from adjacent vertically disposed lands and from circumferential upper and lower label mount regions. Conventionally, the indented panels merge into the adjacent lands via various stepped-shaped walls, grooves, projections or like structures.

Other examples of container sidewalls having flexible panels are disclosed in U.S. Pat. No. 4,749,092 issued to Sugiura et al.; U.S. Pat. No. 3,923,178 issued to Welker III; U.S. Pat. No. 4,497,855 issued to Agrawal et al.; U.S. Pat. No. 5,740,934 issued to Brady; and U.S. Pat. No. 5,704,504 issued to Bueno. The Sugiura, Welker and Agrawal patents disclose inwardly deflecting vacuum flex panels which are located between substantially planar lands; the Bueno patent discloses inwardly deflecting panels which are located between spiral-shaped grooves; and the Brady patent discloses outwardly deflecting panels which intersect at vertically disposed corners.

Although various ones of the above referenced containers may function satisfactorily for their intended purposes, there is a need for a hot-fillable blow molded bottle which integrates functional and aesthetic components in such a manner as to provide a package having enhanced visual interest. Such a package is particularly desirable in single-serve sizes wherein slenderness and single-handed gripability are desirable features.

OBJECTS OF THE INVENTION

With the foregoing in mind, a primary object of the present invention is to provide a hot-fillable bottle which integrates vacuum absorption, structural reinforcement, and other functional features with aesthetic and ergonomic properties by providing various interactive functional zones in the container structure.

Another object of the present invention is to provide a bottle having a plurality of alternating non-framed flex panels and non-framed lands, or columns, which laterally merge together directly and which are jointly reactive to hot-fill process forces acting thereon.

A further object is to provide a blow-molded, plastic, slender bottle having a grip structure which both enhances the structural integrity of the container and the visual appearance of the container.

SUMMARY OF THE INVENTION

More specifically, the present invention provides a blow-molded plastic container having a neck with an upstanding threaded finish, a close-ended base, and a tubular sidewall located between the base and the neck. The sidewall includes, in an alternating pattern, a plurality of circumferentially-spaced, vertically-elongate columns and a plurality of circumferentially-spaced substantially smooth-surfaced panels. Each of the columns, as formed, is outwardly convex in horizontal cross section, and each of the panels, as formed, is inwardly concave in horizontal cross section such that each of the panels extends laterally between and directly connects to an adjacent pair of the columns. In addition, each of the columns, as formed, is outwardly convex in vertical cross-section, and each of the panels, as formed, is inwardly concave in vertical cross section such that each of the columns and panels have opposite ends which merge directly into adjacent portions of the container.

Functionally, each of the panels flexes outwardly to expand the volume of the container during hot-filling, and each of the panels flexes inwardly in response to a reduction in internal volume when the container is capped and permitted to cool. The inward deflection of the panels interactively increases the horizontal cross-sectional convexity of each column and decreases the vertical cross-sectional convexity of each column. The vertical straightening of each column and the lateral pinching of each column combine to structurally strengthen the container.

The aforedescribed structure is particularly suited for slender, single-serve size bottles.

In a preferred embodiment, a plurality of vertically-aligned finger alignment projections are formed integrally on each of the columns to define finger grip locations, to structurally reinforce the columns, and to provide points of visual interest.

BRIEF DESCRIPTION OF THE DRAWINGS

The foregoing and other objects, features and advantages of the present invention should become apparent from the following description when taken in conjunction with the accompanying drawings, in which:

FIG. 3 is a horizontal cross-sectional view taken along line 3—3 of the container illustrated in FIG. 1;

FIG. 4 is a horizontal cross-sectional view taken along line 4—4 of the container illustrated in FIG. 1.

DETAILED DESCRIPTION OF THE PREFERRED EMBODIMENTS

Figure 1:
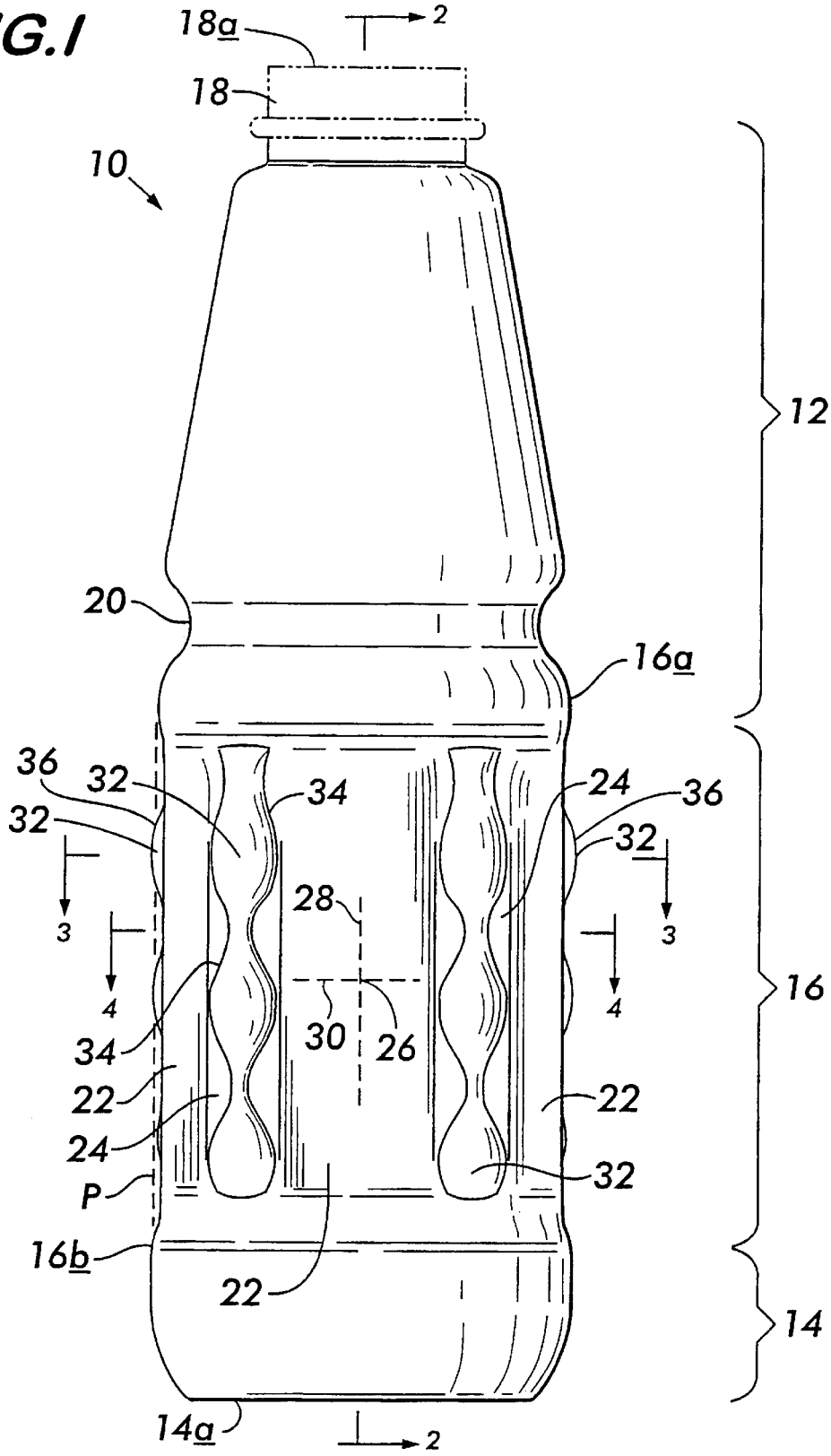
FIG. 1 is an elevational view of a container embodying the present invention.

One embodiment of a slender bottle, or container, 10 according to the present invention is illustrated in FIG. 1. The container 10 has a dome 12, a close ended base 14 and a sidewall 16 located between the dome and base. An upper portion of the dome 12 includes an upstanding threaded finish 18 to which a closure, such as a cap, (not shown) can be attached. A lower portion of the dome 12 includes a circumferential groove, or waist, 20 which provides hoop strength to the bottle to resist ovalization distortion which may otherwise result due to hot-filling and to stiffen the transition between the lower portion of the dome and the sidewall. Optionally, a label can be mounted on the dome 12 between the finish 18 and the groove 20.

Certain novel aspects of the illustrated preferred embodiment are located in the sidewall 16 which is inset between an upper bumper 16*a* and a lower bumper 16*b* and lies entirely within an imaginary cylindrical plane "P" tangent to the outer surface of both. Functionally, the sidewall 16 is capable of expanding when the bottle is filled and is capable of accommodating vacuum absorption when the hot-filled bottle is capped and permitted to cool. In addition, the sidewall 16 is provided with structure which enhances grip-ability of the container 10 and the aesthetic visual appearance of the container 10.

The sidewall 16 is provided with various interactive zones of function. For example, some of the zones are primarily responsible for accommodating vacuum absorption, while other zones are primarily intended to rigidify the container such as by providing post strength to improve container top loading capability. Although each zone may have a primary function, each zone also aids adjacent zones in providing their functions. Thus, the entire sidewall 16, and not merely selected locations, reacts to the forces generated by the hot-fill process on the container 10.

To this end, a plurality of unframed and substantially smooth-surfaced flex panels 22 are provided on the sidewall 16 in an alternating pattern with a plurality of vertically elongate columns 24. The panels 22 provide zones of expansion and vacuum absorption, and the columns 24 provide structural reinforcement zones. Both the panels 22 and the columns 24 react to the forces created by hot-fill processing.

In the "as-formed" condition, ie. after blow-molding but before hot-filling, and in the absence of any internal or external applied forces, the panels 22 are slightly inwardly concave. This is best illustrated in the vertical cross-section of the right hand side of FIG. 2, and in the horizontal cross sections illustrated in FIGS. 3 and 4. The deepest inset portion 26 of each panel 22 is located at the intersection of its vertical centerline 28 and its horizontal centerline 30. In the embodiment illustrated in FIGS. 1–4, each panel 22 is substantially rectangular and is not surrounded by any framing structure such as a stepped wall portion. Rather, all the peripheral edges of each panel 22 merge directly into the adjacent portions of the container as will be discussed.

Figure 2:
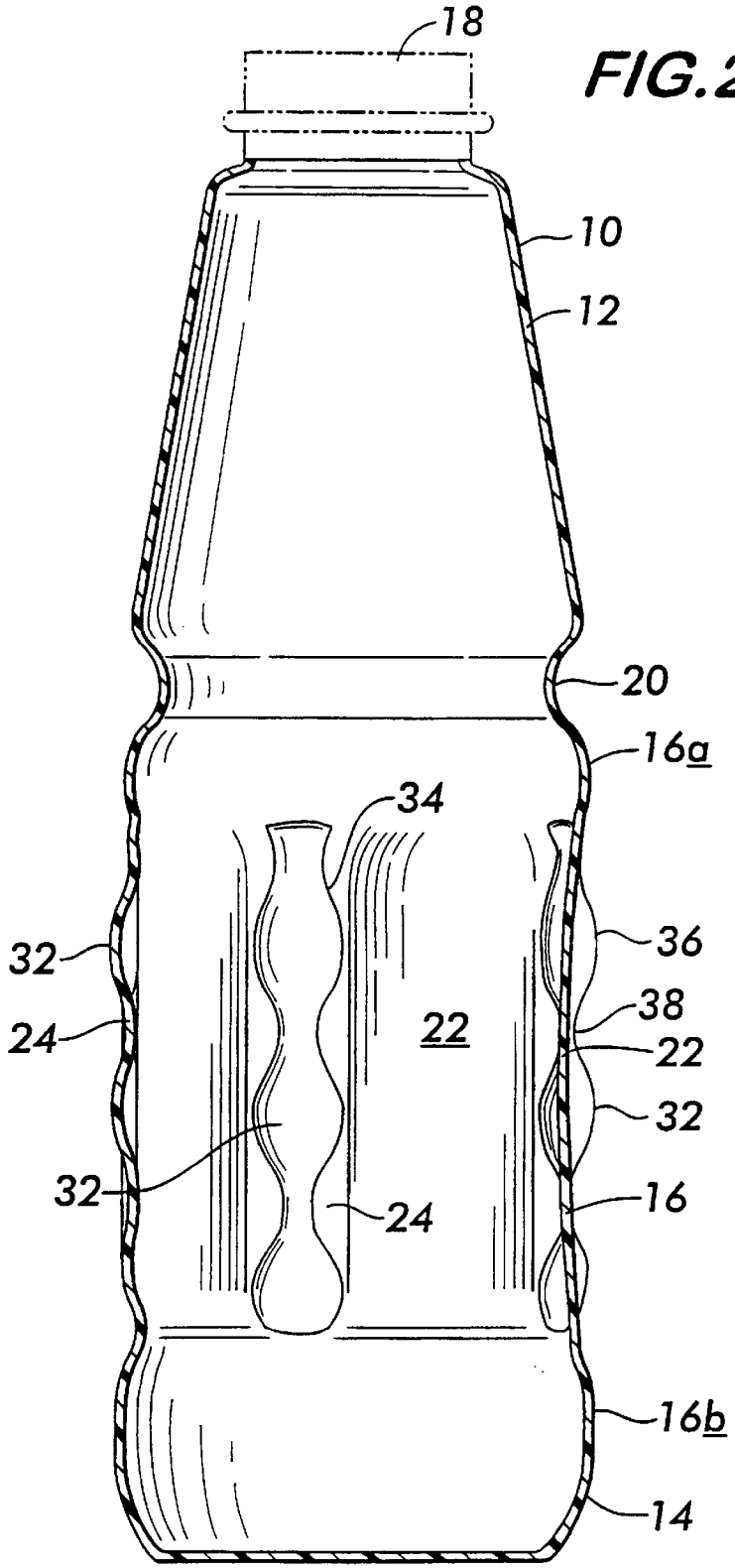
FIG. 2 is a vertical cross-sectional view taken along line 2—2 of the container illustrated in FIG. 1.

In the as-formed condition, the columns 24 are slightly outwardly convex. This is best illustrated in the vertical cross-section of the left hand side of FIG. 2, and in the horizontal cross sections illustrated in FIGS. 3 and 4. Each column 24 is substantially rectangular and is not surrounded by any distinct framing structure, such as a stepped wall. Rather, each column 24 merges smoothly and directly into the adjacent portions of the container. For example, the lateral edges of each panel 22 merge directly into the side edges of an adjacent pair of columns 24. The juncture of the panels 22 and columns 24 are not delineated by other structure; rather, they smoothly transition directly into one another. As best illustrated in FIGS. 1 and 2, the upper and lower edges of the panels 22 and the columns 24 also merge directly into the upper and lower bumpers 16*a* and 16*b*, respectively.

Preferably, the deepest inset portion 26 of each panel 22 is inset into the container 10 an equal pre-determined distance to the most outwardly projecting portion of each column. For example, if each panel 22 is inset approximately 2 mm from an imaginary container datum plane "D" as-formed, then each column projects 2 mm from the container datum plane "D" as-formed. The "container datum plane 'D'" is defined as an imaginary cylindrical plane about which the panels bow inwardly and about which the columns bow outwardly. See the dashed line "D" in FIG. 4.

In another embodiment, which provides certain additional structural and functional advantages over the first-described embodiment, is illustrated in FIGS. 5–9. The container 110 includes a base 114, a sidewall 116 and a dome 112 having a finish 118. In this embodiment, each column, such as the column 124, has an hourglass-shape in vertical elevation, with its narrowest region located at the vertical median of the sidewall 116 as determined by section line 7—7. From there, the column flares outwardly in both upward and downward directions. Each panel 122 between adjacent columns 124 is complementary and has its widest portion at the sidewall median and narrows therefrom in both upward and downward directions. Both the columns and the panels merge smoothly outwardly with the upper and lower bumpers 116*a* and 116*b*, respectively.

In this embodiment, each of the finger grip protrusions 132, as discussed below, is of equal size, shape and radial extent providing better grip-ability without sacrificing flexural performance.

Figure 6:
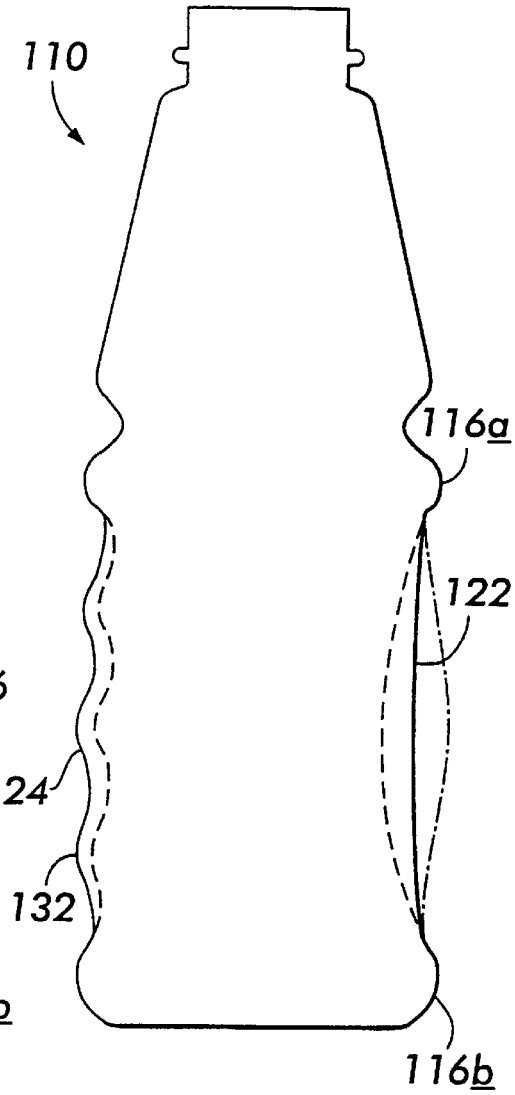
FIG. 6 is a vertical cross-sectional view taken along line 6—6 of the container illustrated in FIG. 5.
Figure 7:
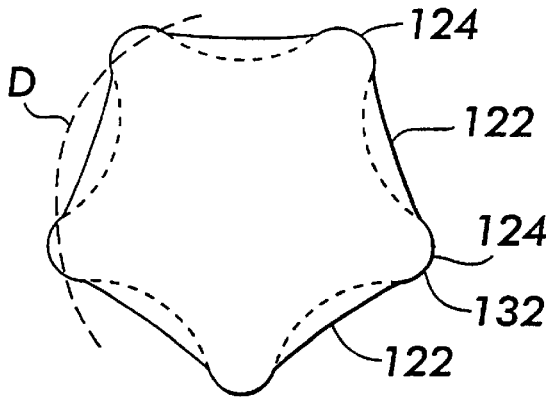
FIG. 7 is a horizontal cross-sectional view taken along line 7—7 of the container illustrated in FIG. 5.
Figure 8:
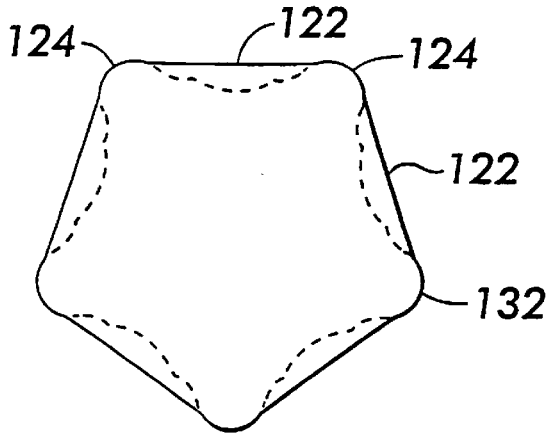
FIG. 8 is a horizontal cross-sectional view taken along line 8—8 of the container illustrated in FIG. 5.
Figure 9:
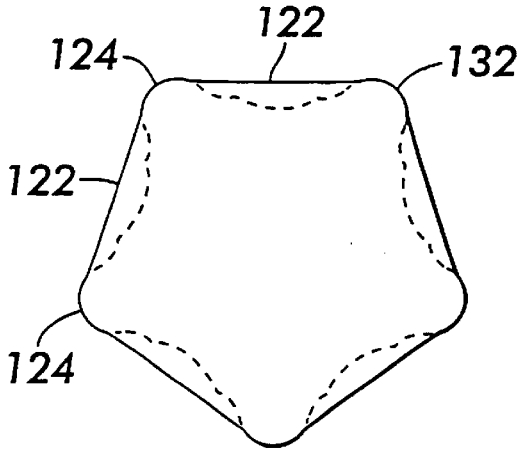
FIG. 9 is a horizontal cross-sectional view taken along line 9—9 of the container illustrated in FIG. 5.

When the containers 10, 110 are hot-filled with a beverage, each panel 22, 122 initially deflects outwardly slightly, as best shown for container 110 exaggerated in dot-dash line in FIG. 6, to increase the volume of the containers 10, 110. After the containers 10 and 110 are hot-filled, capped and permitted to cool, each panel 22, 122 deflects inwardly to effectively reduce the volume of each container 10 and 110, as best illustrated greatly exaggerated for container 110 by the dashed lines in FIGS. 6 and 7–9.

Each of the columns 24, 124 also reacts to the forces created in the hot-filled, capped and cooled containers 10 and 110. In horizontal cross-section, the convexity of each column 24, 124 increases due to the lateral pinching of the inwardly deflecting adjacent panels 22, 122. In vertical cross-section, each column 24, 124 straightens. The combination of the lateral pinching and the vertical straightening creates more column structure as more vacuum develops in the container. The increase in column structure increases the post strength provided by the columns 24, 124 and provides the filled and capped containers 10 and 110 with increased top loading capability. The intended altered shape of the columns 24, 124 also aids in resisting unwanted container distortion and provides enhanced visual aesthetic interest in the container. Note the deflection relative to the container datum plane "D" in FIG. 7.

Figure 5:
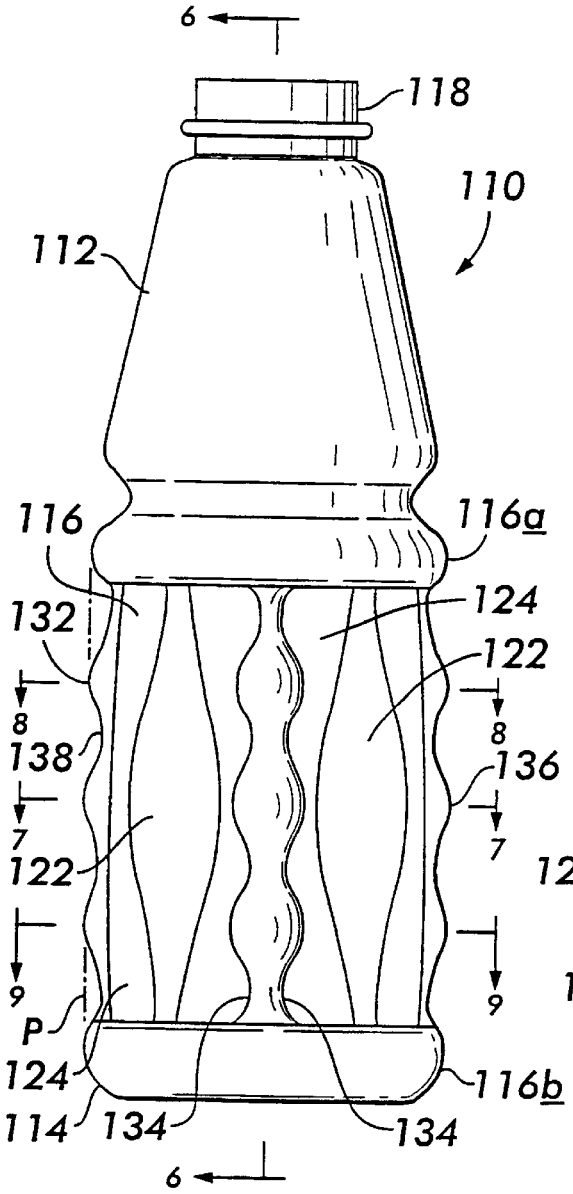
FIG. 5 is an elevational view of a second embodiment of a container according to the present invention.

Preferably, each column 24, 124 is provided with a plurality of vertically aligned protrusions 32, 132 on about one inch centers. In vertical elevation, the protrusions are defined by laterally undulating lines of inflection 34, 134 and radially undulating surfaces 36, 136. The outward extent of the radially-undulating surfaces 36 may vary in radial extent, from maximum at the top to minimum at the bottom, such as illustrated in FIG. 1, or may be of equal extent such as illustrated in the embodiment of FIG. 5. The outward protrusions 32, 132 define therebetween valleys 38, 138 affording finger placement locations to improve gripability of the container. The pattern of protrusions 32, 132 also provides visual interest and structurally reinforces the columns 24, 124 at certain desired locations while affording the desired flexure at certain other desired locations.

The present invention is particularly suited for use in slender bottles, ie. bottles having a predetermined slenderness ratio. Slenderness ratio as used herein is the length of the bottle 10, of FIG. 1, measured axially from the upper edge 18*a* of the finish 18 to the bottom of the standing ring 14*a* of the base 14 divided by the mean diameter of the sidewall 16, or body portion, located between the bottom of the dome 12 and the base 14. In the illustrated bottle 10, the slenderness ratio is 3.3:1. The bottle 10 is drawn to full scale. In has an overall length of about 22.9 cm (9 inches) and a 0.7 liter (24 ounce) filled capacity.

By way of example, and not by way of limitation, each bottle, such as the bottle 10, may be designed to contain between about a 0.2 liters (about 8 ounces) to about 1.9 liters (about 64 ounces) of a beverage. The sidewall 16 may include any number of panels 22, 122 and columns 24, 124, such as in a range of two through ten. The deepest inset portion 26 of each panel in the as-formed condition of the container relative to the container datum plane "D" is about 1 to about 4 mm. The circumferential groove 20 in the dome 12 is approximately 6 to 7 mm in depth and approximately 4 to 5 mm in height. The filled and capped containers 10 are capable of being packed and shipped in an efficient amount of space because the panels 22 of one container's sidewall interdigitate with the columns 24 of the adjacent containers to minimize packing volume.

Figure 10:
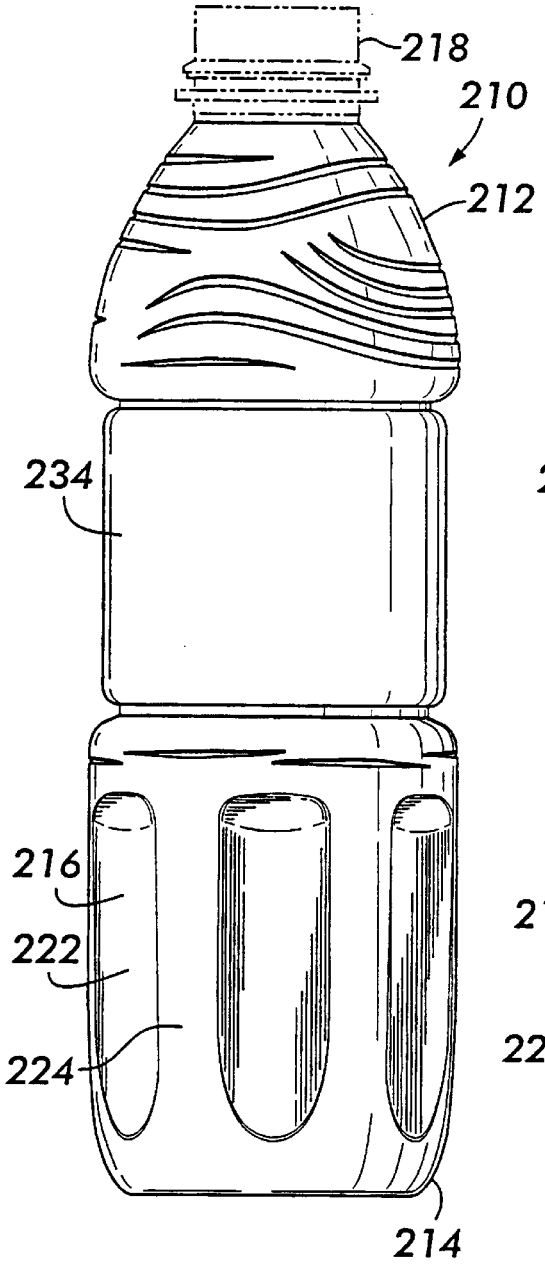
FIG. 10 is an elevational view of a third embodiment of a container according to the present invention.
Figure 11:
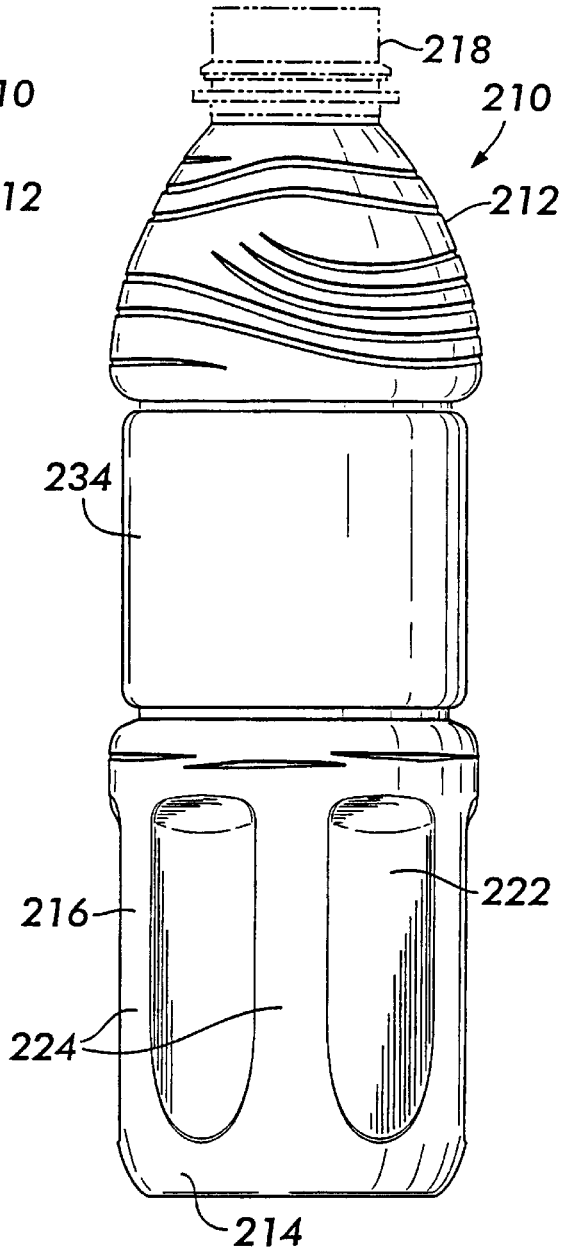
FIG. 11 is an elevational view of the container illustrated in FIG. 10 rotated 30° about a vertical axis extending centrally through the container.

A third embodiment of the present invention is provided by container 210 as illustrated in FIGS. 10 and 11. The hot-fillable plastic container 210 has a dome 212 with a finish 218, a lower sidewall 216 adjacent a base 214, and a substantially cylindrical intermediate sidewall 234 to which a label (not shown) can be secured. The lower sidewall 216 includes six vertically-elongate unframed flex panels 222 in an alternating array with six vertically-elongate columns 224 which, when hot-filled, function similar to the unframed flex panels and columns as disclosed above for containers 10 and 110.

Thus, the present invention provides a hot-fillable container which integrates various functional and aesthetic features without clearly segregating the features. Unframed panels and columns interact to provide vacuum absorption functions and structural reinforcement functions. As more vacuum develops in the container, greater structural functions develop in the container sidewall to provide a container which is functional, structurally strong and visually aesthetic.

Various modifications to the container are contemplated. For instance, such modifications may include the use of an odd or an even number of panels, vacuum absorption and structural zones located in the dome of the container, and finger grips provided by indentations instead of protrusions.

While preferred embodiments of containers having a sidewall with unframed flex panels have been described, various modifications, alterations, and changes may be made without departing from the spirit and scope of the present invention as defined in the appended claims.

What is claimed is:

1. A blow-molded plastic bottle (10, 110, 210) having a dome (12, 112, 212) with an upstanding finish (18, 118, 218), a base (14, 114, 214), and a substantially tubular sidewall (16, 116, 216) between the base (14, 114, 214) and the dome (12,112, 212), said sidewall (16, 116, 216) comprising:

an alternating pattern of a plurality of circumferentially-spaced vertically-elongate columns (24, 124, 224) and a plurality of circumferentially-spaced substantially smooth-surfaced panels (22, 122, 222);

each of said columns (24, 124, 224), as formed, being outwardly convex in horizontal cross section and each of said panels (22, 122, 222), as formed, being inwardly concave in horizontal cross section with each of said panels (22, 122, 222) extending laterally between and connecting directly to an adjacent pair of said columns (24, 124, 224); and each of said columns (24, 124, 224), as formed, being outwardly convex in vertical cross section and each of said panels (22, 122, 222), as formed, being inwardly concave in vertical cross section with each of said columns (24, 124, 224) and panels (22, 122, 222) having opposite ends merging directly into adjacent portions of the bottle (10, 110, 210).

2. A blow-molded plastic bottle (10, 110, 210) according to claim 1, wherein each of said panels (22, 122, 222) flexes outwardly during hot-filling and inwardly in response to a reduction in internal volume when the bottle (10, 110, 210) is capped and permitted to cool; and wherein said inward deflection of said panels (22, 122, 222) increases the horizontal cross-sectional convexity of each of said columns (24, 124, 224), whereby said increased horizontal cross-sectional convexity structurally enhances bottle strength.

3. A blow-molded plastic bottle (10, 110, 210) according to claim 2, wherein each of said as-formed outwardly convex vertical cross-sections of each column (24, 124, 224) straightens in response to the reduction in internal volume when the bottle (10, 110, 210) is hot-filled, capped and permitted to cool; and wherein said vertical straightening structurally enhances the strength of the bottle (10, 110, 210).

4. A blow-molded plastic bottle (10, 110) according to claim 3, further comprising a plurality of vertically-aligned finger alignment protrusions (32,132) formed integrally on each of said columns (24, 124).

5. A blow-molded plastic bottle (10, 110) according to claim 4, wherein said sidewall (16, 116) has a number of said panels (22, 122) in a range of two through ten and an equal number of said columns (24, 124).

6. A blow-molded plastic bottle (10, 110) according to claim 5, wherein said sidewall (16, 116) has five of said panels (22, 122) and five of said columns (24, 124) affording side-by-side packing with like bottles (10, 110) in a minimum of space with said columns (24, 124) of one bottle (10, 110) interdigitating with said panels (22, 122) of adjacent bottles (10, 110).

7. A slender blow-molded plastic bottle (10, 110, 210) comprising:

an upper portion with a dome (12, 112, 212) having an upstanding finish (18, 118, 218) capable of being sealed with a closure;

a lower portion having a base (14, 114, 214); and a generally tubular intermediate sidewall portion (16, 116, 216) between said upper and lower portions, said sidewall portion (16, 116, 216) being formed with a plurality of circumferentially-spaced vertically-elongate columns (24, 124, 224) in an alternating pattern with a plurality of circumferentially-spaced substantially smooth-surfaced panels (22, 122, 222);

each of said columns (24, 124, 224), as formed, being outwardly convex in horizontal cross section and each of said panels (22, 122, 222), as formed, being inwardly concave in horizontal cross section such that each of said panels (22, 122, 222) extends laterally between and connects directly to an adjacent pair of said columns (24, 124, 224);

each of said columns (24, 124, 224), as formed, being outwardly convex in vertical cross section and each of said panels (22, 122, 222), as formed, being inwardly concave in vertical cross section such that each of said columns (24, 124, 224) and panels (22, 122, 222) has opposite ends which merge directly into adjacent portions of the bottle (10, 110, 210);

each of said panels (22, 122, 222) flexing outwardly to expand the volume of the bottle (10, 110, 210) during hot-filling and each of said panels (22, 122, 222) flexing inwardly in response to a reduction in internal volume after the bottle (10, 110, 210) is capped and permitted to cool; and said inward deflection of said panels (22, 122, 222) functioning to increase the horizontal cross-sectional convexity of each of said columns (24, 124, 224) and of decreasing the vertical cross-section convexity of each of said columns (24, 124, 224).

8. A slender blow-molded plastic bottle (10, 110) according to claim 7, further comprising a plurality of vertically-aligned finger alignment protrusions (32, 132) formed integrally on each of said columns (24, 124) to define therebetween finger grip locations and to structurally reinforce said columns (24, 124) at desired locations.

9. A slender blow-molded plastic bottle (10, 110) according to claim 7, wherein each of said panels (22, 122) has a vertical center line and a pair of lateral side edges, and each of said columns (24, 124) has a vertical center line and a pair of lateral side edges; wherein, in the as-formed condition of the bottle (10, 110), each of said panels (22, 122) at said panel center line extends radially inward a pre-determined distance relative to said panel side edges and each of said columns (24, 124) at said column center line extends radially outward a pre-determined distance relative to said column side edges; wherein said column and panel side edges lie on a cylindrical datum plane (D); and wherein said pre-determined distances of said panels and columns are substantially equal.

10. A slender blow molded plastic bottle (10, 110) according to claim 9, wherein said pre-determined distances of said panels (22, 122) and said columns (24, 124) are in the range of about 1 to about 4 mm.

11. A slender blow-molded plastic bottle (10) according to claim 7, wherein each of said columns (24) has a substantially rectangular periphery.

12. A slender blow molded plastic bottle (110) according to claim 7, wherein each of said columns (124) has an hourglass-shaped configuration with a minimum peripheral extent at about a vertical median of the sidewall (116).

13. A slender blow-molded plastic bottle (10, 110) according to claim 7, wherein each of said panels (22, 122) and each of said columns (24, 124) has upper peripheral edges positioned in an end-to-end array having a substantially circular horizontal cross-sectional shape; and wherein each of said panels (22, 122) and each of said columns (24, 124) have lower peripheral edges positioned in an end-to-end array having a substantially circular horizontal cross-sectional shape.

14. A slender blow-molded plastic bottle (10, 110) according to claim 13, wherein said sidewall portion (16, 116) has two to ten of said panels (22, 122) and an equal number of said columns (24, 124).

15. A blow-molded slender plastic bottle (10, 110) comprising:

a dome (12, 112) having an upper portion with an upstanding sealable finish (18, 118) and a lower portion with a circumferential groove providing a waist (20);

a base (14, 114); and a tubular sidewall (16, 116) between said dome (12, 112) and said base (14, 114), said sidewall (16, 116) being formed with a plurality of circumferentially-spaced vertically-elongate columns (24, 124) disposed in an alternating pattern with a plurality of circumferentially-spaced substantially smooth-surfaced panels (22, 122);

each of said columns (24, 124), as formed, being outwardly convex in horizontal cross section and each of said panels (22, 122), as formed, being inwardly concave in horizontal cross section such that each of said panels (22, 122) extends laterally between and merges directly with an adjacent pair of said columns (24, 124);

each of said columns (24, 124), as formed, being outwardly convex in vertical cross section and each of said panels (22, 122), as formed, being inwardly concave in vertical cross section such that each of said columns (24, 124) and panels (22, 122) has opposite ends which merge directly into said dome (12, 112) and base (14, 114) of the bottle (10, 110);

each of said panels (22, 122) flexing outwardly to expand the volume of the bottle (10, 110) during hot-filling and each of said panels (22, 122) flexing inwardly in response to a reduction in internal volume when the bottle (10, 110) is capped and permitted to cool; and said inward deflection of said panels (22, 122) increasing the horizontal cross-sectional convexity and decreasing the vertical cross-sectional convexity of each of said columns (24, 124) for structurally enhancing bottle top loading strength.

16. A blow-molded slender plastic bottle (10, 110) according to claim 15, further comprising a plurality of vertically-aligned outwardly protruding finger alignment protrusions (32, 132) formed integrally on each of said columns (24, 124) to define finger grip locations and to structurally modify the strength of said columns (24, 124) at desired locations.

17. A blow-molded slender plastic bottle (10, 110) according to claim 15, wherein each of said panels (22, 122) has a central portion with a periphery, and each of said columns (24, 124) has a central portion with a periphery; wherein, in the as-formed condition of the bottle (10, 110), each of said panels (22, 122) at said central portion extends radially inward a pre-determined distance relative to said panel periphery and each of said columns (24, 124) at said column central portion extends radially outward a pre-determined distance relative to said column periphery; and wherein said pre-determined distances of said panels (22, 122) and columns (24, 124) are substantially equal.

18. A blow-molded slender plastic bottle (10, 110) according to claim 15, having a slenderness ratio of about 3.3:1.

19. A blow-molded slender plastic bottle (10, 110) according to claim 15, having upper and lower bumpers ( 16*a*, 16*b*, 116*a*, 116*b*) above and below said sidewall (16, 116), and wherein said columns (24, 124), in said bottle as-formed condition, lie within a cylindrical plane (P) tangent to said bumpers (16*a*, 16*b*, 116*a*, 116*b*).

20. A blow-molded slender plastic bottle (10, 110) according to claim 19, having a cylindrical datum plane (D) coaxial with said first-mentioned cylindrical plane (P) and located inwardly thereof, said cylindrical datum plane (D) at said sidewall vertical median defining a reference with respect to which said columns (24, 124) and said panels (22, 122) flex.

* * * * *